US010569535B2

(12) United States Patent
Anderson et al.

(10) Patent No.: US 10,569,535 B2
(45) **Date of Patent: *Feb. 25, 2020**

(54) CRACK SENSING FOR PRINTHEAD HAVING MULTIPLE PRINTHEAD DIE

(71) Applicant: HEWLETT-PACKARD DEVELOPMENT COMPANY, L.P., Fort Collins, CO (US)

(72) Inventors: Darryl E. Anderson, Corvallis, OR (US); George H. Corrigan, Corvallis, OR (US); Scott A. Linn, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 11 days.

This patent is subject to a terminal disclaimer.

(21) Appl. No.: 15/688,530

(22) Filed: Aug. 28, 2017

(65) Prior Publication Data

US 2017/0355185 A1 Dec. 14, 2017

Related U.S. Application Data

(63) Continuation of application No. 15/543,420, filed as application No. PCT/US2015/013953 on Jan. 30, 2015, now Pat. No. 10,124,579.

(51) Int. Cl.
*B41J 2/045* (2006.01)
*B41J 2/14* (2006.01)
(Continued)

(52) U.S. Cl.
CPC ..... *B41J 2/0451* (2013.01); *B41J 2/0458* (2013.01); *B41J 2/04501* (2013.01);
(Continued)

(58) Field of Classification Search
CPC ..... B41J 2202/20; B41J 2/1433; B41J 2/14; B41J 2/175; B41J 2/145; B41J 2/0458;
(Continued)

(56) References Cited

U.S. PATENT DOCUMENTS 5,942,900 A 8/1999 DeMeerleer et al.
7,547,087 B2 6/2009 Cato et al.
(Continued)

FOREIGN PATENT DOCUMENTS

CN 1316332 10/2001
CN 1919603 2/2007
(Continued)

OTHER PUBLICATIONS

Megawavz, Ryeco Actuator, http://www.megawavz.com/product.aspx?id=344736&desc=Ryeco_20123100_+_20063905_Actuator_+_Printhead . . . , Dec. 16, 2014, 1 pg.

*Primary Examiner* — Jannelle M Lebron
(74) *Attorney, Agent, or Firm* — Dicke Billig & Czaja PLLC

(57) ABSTRACT

One example provides a printhead including a plurality of printhead dies, each printhead die including at least one crack sense resistor. At least one analog bus is connected to each printhead die, the at least one analog bus to output voltages to facilitate a printer controller to determine whether at least one of the printhead dies is cracked.

27 Claims, 7 Drawing Sheets

(51) Int. Cl.
*B41J 2/175* (2006.01)
*B41J 2/145* (2006.01)

(52) U.S. Cl.
CPC ..... *B41J 2/04581* (2013.01); *B41J 2/04586* (2013.01); *B41J 2/145* (2013.01); *B41J 2/14153* (2013.01); *B41J 2/175* (2013.01); *B41J 2202/20* (2013.01); *B41J 2202/21* (2013.01)

(58) Field of Classification Search
CPC B41J 2/04551; B41J 2/04501; B41J 2/04586; B41J 2/04581; B41J 2/14153; B41J 2202/21
See application file for complete search history.

(56) References Cited

U.S. PATENT DOCUMENTS

| | | | |
|---|---|---|---|
| 7,571,975 | B2 | 8/2009 | Lee et al. |
| 8,870,337 | B1 | 10/2014 | Jensen et al. |
| 8,888,226 | B1 | 11/2014 | Gardner et al. |
| 10,124,579 | B2 * | 11/2018 | Anderson ..... B41J 2/14153 |
| 2006/0125870 | A1 | 6/2006 | Lee et al. |
| 2007/0046714 | A1 | 3/2007 | Beak et al. |
| 2012/0120138 | A1 | 5/2012 | Banerjee et al. |
| 2013/0070012 | A1 | 3/2013 | Yokouchi |
| 2014/0320566 | A1 | 10/2014 | Jensen et al. |

FOREIGN PATENT DOCUMENTS

| | | |
|---|---|---|
| CN | 102781671 | 11/2012 |
| JP | 2010234611 | 10/2010 |

* cited by examiner

CRACK SENSING FOR PRINTHEAD HAVING MULTIPLE PRINTHEAD DIE

CROSS REFERENCE

This Application is a Continuation of U.S. application Ser. No. 15/543,420, which entered National Stage Jul. 11, 2017 based on PCT/US2015/013953 filed Jan. 30, 2015 both of which are incorporated herein by reference.

BACKGROUND

Printing devices provide a user with a physical representation of a document by printing a digital representation of the document onto a print medium. Some printing devices, such as wide array printing devices, include a printhead having a number of printhead die, where each printhead die ejects ink drops through a plurality of nozzles onto the print medium to form the physical representation of the document.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Printing devices provide a user with a physical representation of a document by printing a digital representation of the document onto a print medium. Some printing devices, such as wide array printing devices, include a printhead having multiple printhead dies, where each printhead die ejects ink drops through a plurality of nozzles onto the print medium to form the physical representation of the document.

Printhead die are prone to hairline cracks along edges of the die where sawing occurred during die separation, or at corners of ink slots where machining or etching occurred during creation of the ink slots. These hairline cracks can propagate through the die into circuit regions and cause circuits to malfunction. Printhead die often include measurement and control circuitry to monitor the printhead die for cracks. However, such measurement and control circuitry uses significant space on printhead silicon and, thus, is costly.

Figure 1:
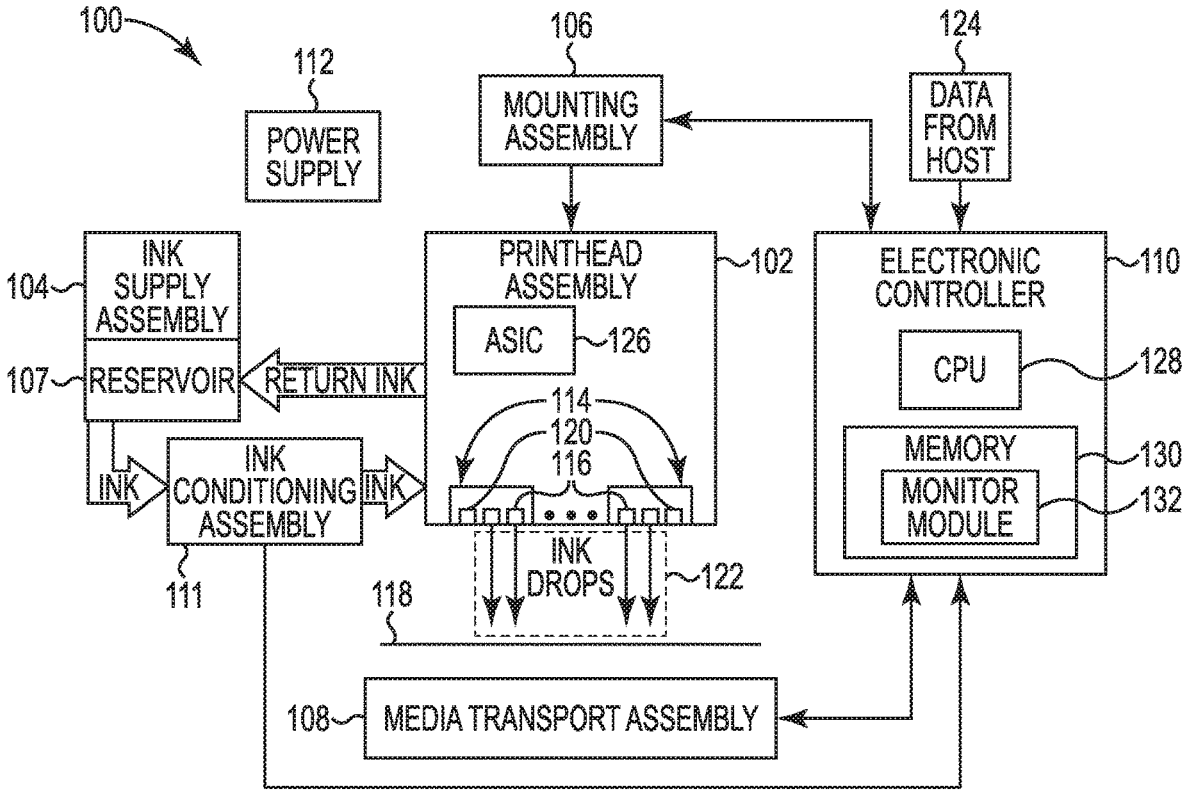
FIG. 1 is a block and schematic diagram illustrating an inkjet printing system, including a fluid ejection device, having crack sensing for multiple printhead die, according to one example.

FIG. 1 is a block and schematic diagram illustrating generally an inkjet printing system 100 including a fluid ejection device, such as a fluid drop ejecting printhead, having a plurality of printhead die, each printhead die including at least one crack sense element, such as a crack sense resistor, for example. As will be described in greater detail herein, accordance with the present disclosure, an application specific circuit (ASIC) apart from the plurality of printhead die includes measurement and control circuitry for performing time-multiplexed crack sensing of all of the printhead die via the crack sense resistors in each printhead die. Consolidating measurement and control circuitry in an ASIC, as opposed to each printhead die having its own measurement and control circuitry, greatly reduces cost and reduces space requirements for such circuitry on individual printhead die.

Inkjet printing system 100 includes an inkjet printhead assembly 102, an ink supply assembly 104 including an ink storage reservoir 107, a mounting assembly 106, a media transport assembly 108, an electronic controller 110, and at least one power supply 112 that provides power to the various electrical components of inkjet printing system 100.

Inkjet printhead assembly 102 includes a plurality of printhead dies 114, each of which ejects drops of ink through a plurality of orifices or nozzles 116 toward print media 118 so as to print onto print media 118. In one example, inkjet printhead assembly 102 is a wide array printhead. With properly sequenced ejections of ink drops, nozzles 116, which are typically arranged in one or more columns or arrays, produce characters, symbols or other graphics or images to be printed on print media 118 as inkjet printhead assembly 102 and print media 118 are moved relative to each other.

In one example, each printhead die 114 includes at least one crack sensor element 120 for detecting cracks along the edges of, or at other location within, printhead dies 114. According to one example, crack sensor element is a crack sense resistor (i.e. crack sense resistor 120). In one example, as will be described in greater detail below, printhead assembly 102 includes a sensor controller 126 for controlling crack sensor elements 120 to monitor printhead dies 114 for cracks, which is separate from any of the printhead dies 114. In one example, sensor controller 126 is an ASIC (i.e. ASIC 126).

In operation, ink typically flows from reservoir 107 to inkjet printhead assembly 102, with ink supply assembly 104 and inkjet printhead assembly 102 forming either a one-way ink delivery system or a recirculating ink delivery system. In a one-way ink delivery system, all of the ink supplied to inkjet printhead assembly 102 is consumed during printing. However, in a recirculating ink delivery system, only a portion of the ink supplied to printhead assembly 102 is consumed during printing, with ink not consumed during printing being returned to supply assembly 104. Reservoir 107 may be removed, replaced, and/or refilled.

In one example, ink supply assembly 104 supplies ink under positive pressure through an ink conditioning assembly 11 to inkjet printhead assembly 102 via an interface connection, such as a supply tube. Ink supply assembly includes, for example, a reservoir, pumps, and pressure regulators. Conditioning in the ink conditioning assembly may include filtering, pre-heating, pressure surge absorption, and degassing, for example. Ink is drawn under negative pressure from printhead assembly 102 to the ink supply assembly 104. The pressure difference between an inlet and an outlet to printhead assembly 102 is selected to achieve correct backpressure at nozzles 116, and is typically a negative pressure between negative 1 and negative 10 of H20.

Mounting assembly 106 positions inkjet printhead assembly 102 relative to media transport assembly 108, and media transport assembly 108 positions print media 118 relative to inkjet printhead assembly 102, so that a print zone 122 is defined adjacent to nozzles 116 in an area between inkjet printhead assembly 102 and print media 118. In one example, inkjet printhead assembly 102 is scanning type printhead assembly. According to such example, mounting assembly 106 includes a carriage from moving inkjet printhead assembly 102 relative to media transport assembly 108 to scan printhead dies 114 across printer media 118. In another example, inkjet printhead assembly 102 is a non-scanning type printhead assembly. According to such example, mounting assembly 106 maintains inkjet printhead assembly 102 at a fixed position relative to media transport assembly 108, with media transport assembly 108 positioning print media 118 relative to inkjet printhead assembly 102.

Electronic controller 110 includes a processor (CPU) 128, a memory 130, firmware, software, and other electronics for communicating with and controlling inkjet printhead assembly 102, mounting assembly 106, and media transport assembly 108. Memory 130 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for inkjet printing system 100.

Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters. In one implementation, electronic controller 110 controls inkjet printhead assembly 102 for the ejection of ink drops from nozzles 116 of printhead dies 114. Electronic controller 110 defines a pattern of ejected ink drops to form characters, symbols, and/or other graphics or images on print media 118 based on the print job commands and/or command parameters from data 124.

In one example, memory 130 of electronic controller 110 includes a monitor module 132 including instructions that, when executed by processor 128, determine a type of monitoring scheme to employ for crack monitoring of printhead dies 114, and that instruct ASIC 126 to perform functions to provide crack monitoring of printhead dies 114 in accordance any number of possible monitoring schemes. As will be described in greater detail below, any number of monitoring schemes can be employed, such as a round-robin monitoring scheme where printhead dies 114 are successively monitored for cracks via crack senor elements 120 in a repeating order. Another example monitoring scheme includes successively monitoring groups of printhead die 114 in a parallel fashion.

Although described herein primarily with regard to inkjet printing system 100, which is disclosed as a drop-on-demand thermal inkjet printing system with a thermal inkjet (TIJ) printhead dies 114, crack sense elements 120 and ASIC 126 can also be implemented in other printhead types as well. For example, crack sense elements 120 and ASIC 126, according to the present disclosure, may be implemented with piezoelectric type printhead assemblies. As such, crack sense elements 120 and ASIC 126, according to the present disclosure, are not limited to implementation in a TIJ printhead, such as printhead dies 114.

Figure 2:
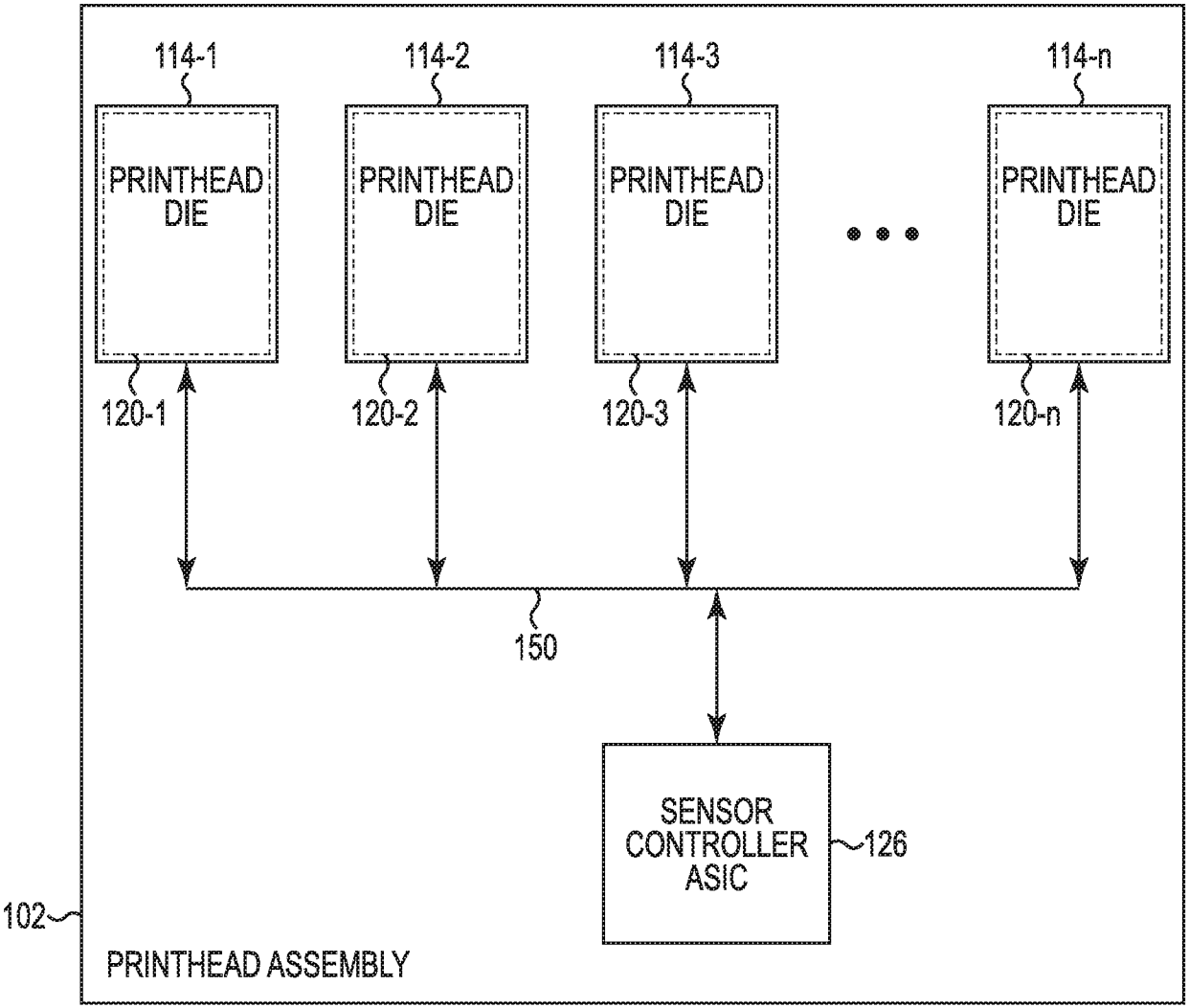
FIG. 2 is block and schematic diagram illustrating a printhead having crack sensing for multiple printhead die, according to one example

FIG. 2 is a block and schematic diagram illustrating generally printhead assembly 102 according to one example. Printhead assembly 102 includes a plurality of printhead dies 114, illustrated as printhead dies 114-1, 114-2, and 114-3 to **114-*n*, with each printhead die 114 including at least one crack sense resistor 120. According to one example, as illustrated by FIG. 2, each printhead die 114 includes a corresponding crack sense resistor 120-1-120-*n* extending about a perimeter edge of printhead die 114. Crack sense resistors 120 can be also be disposed at other locations within printhead dies 114. ASIC 126, which is apart and separate from any of the printhead dies 114, is coupled to each of the printhead dies 114 via an analog bus 150 which is electrically coupled to each crack sense resistor 120. In operation, as will be described in greater detail below, ASIC 126 is configured to provide a known current on analog bus 150 to at least one crack sense resistor 120 of at least one printhead die of the plurality of printhead dies 114 and monitors a resulting voltage response on analog bus 150 to evaluate a structural integrity of the at least one printhead die 114**.

Figure 3:
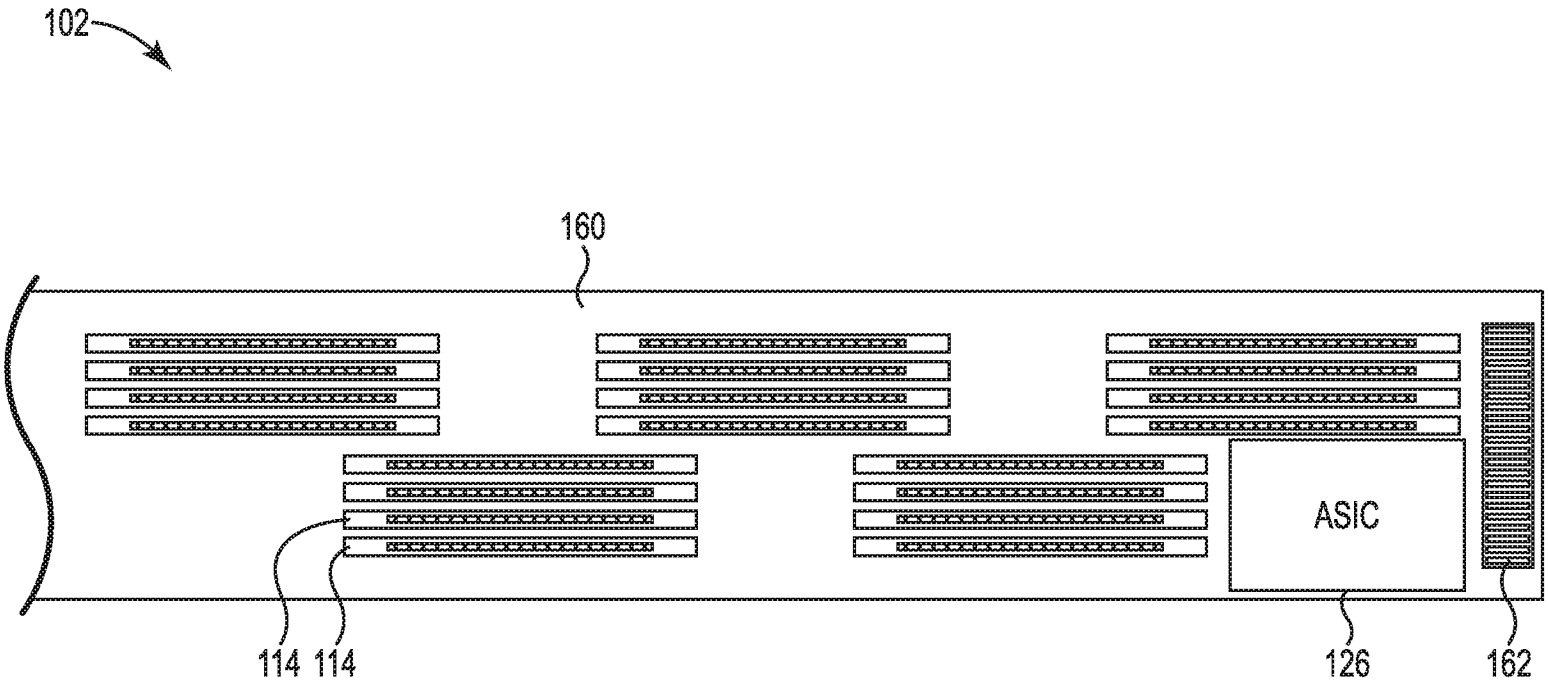
FIG. 3 is a block and schematic diagram generally illustrating a wide array inkjet printhead employing multiple printhead dies according to one example.

FIG. 3 is a block diagram illustrating an example of printhead assembly 102, in accordance with the present disclosure, configured as a wide array printhead assembly 102. According to such example, wide array printhead assembly 102 includes a plurality of printhead die 114 disposed on a substrate 160 along with ASIC 126 which is communicatively connected to each printhead die 114. A plurality of electrical connections 162 facilitate data and power transfer to printhead dies 114 and ASIC 126. Although illustrated as being positioned at one end of printhead assembly 102, proximate to electrical connections 162, it is noted that ASIC 126 can be located at any number of positions on substrate 160.

According to the example of FIG. 3, printhead dies 114 are organized into groups of four to facilitate full color printing using three colored inks and black ink. In one example, the groups of printhead dies 114 are offset and staggered to provide overlap between the nozzles 116 of printhead dies 114 (see FIG. 1).

Figure 4:
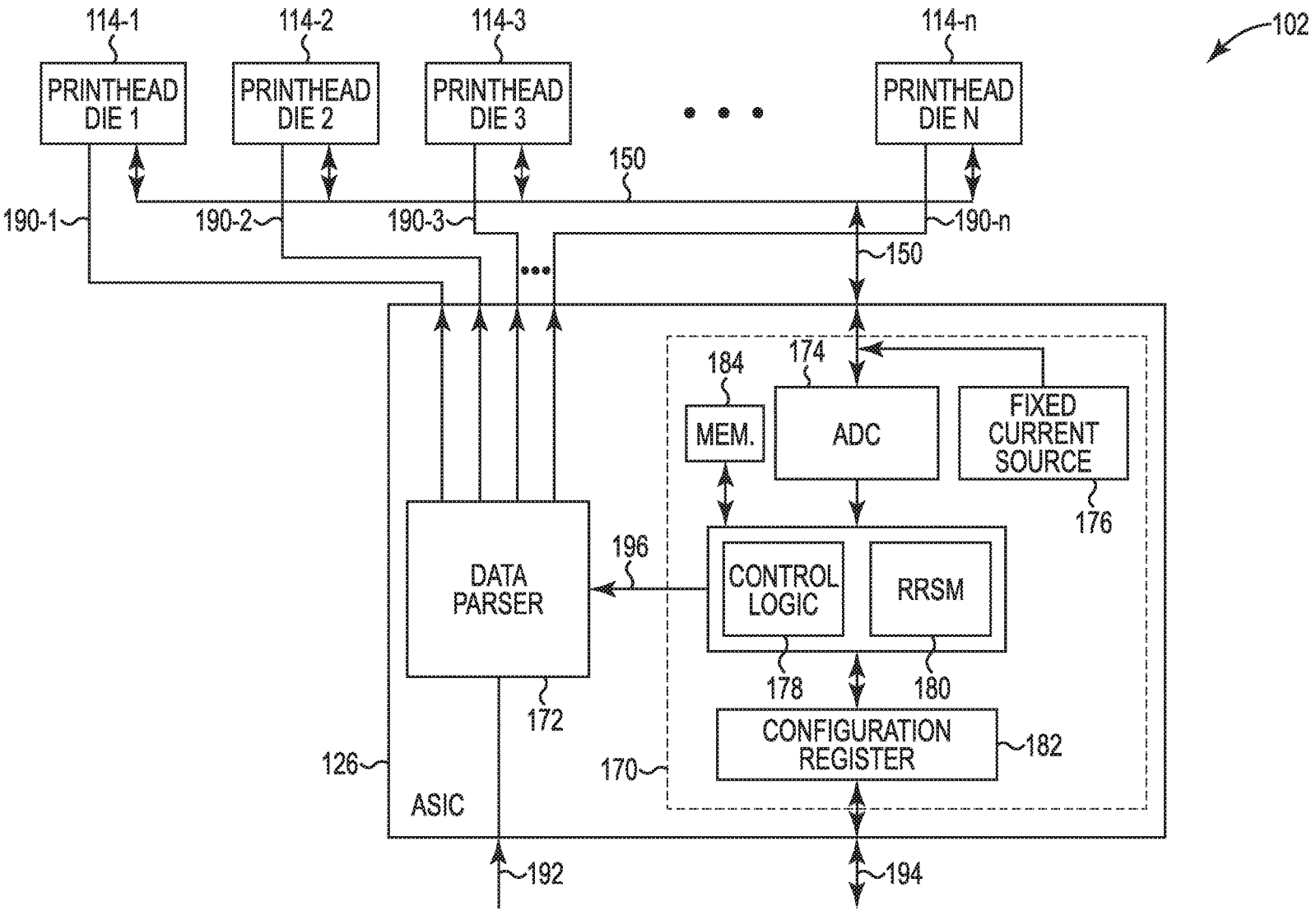
FIG. 4 is a block and schematic diagram of a printhead having crack sensing for multiple printhead die according to one example.

FIG. 4 is a block and schematic diagram showing an example of printhead assembly 102, configured as a wide array printhead, and illustrating an example of sensor controller ASIC 126 in greater detail. ASIC 126 includes sensor control circuitry 170 and a data parser 172, with sensor control circuitry 170 including an analog-to-digital converter (ADC) 174, a fixed current source 176, control logic 178, a round-robin state machine (RRSM) 180, a configuration register 182, and a memory 184. Printhead dies 114 are coupled to ADC 174 and fixed current source 176 via analog bus 150. Data parser 172 is separately coupled to each of the printhead dies 114 via corresponding printhead data lines 190 (e.g. printhead data lines 190-1, 190-2, and 190-3 to **190-*n*) and receives print data on print data line 192 from electronic controller 110 (see FIG. 1). Sensor control circuitry 170, via configuration register 182, is connected to a configuration channel 194 for communication with electronic controller 110 (see FIG. 1). In another example, in lieu of a separate configuration channel 194, configuration register 812 is in communication with electronic controller 110 via print data line 192. Control logic 178 and RRSM 180 are in communication with data parser 172 via a command line 196**.

According to some example, data may be stored on memory 184 that assists in the functionality of the sensor control circuitry 170 as described herein. For example, the memory 184 may store executable code associated monitoring schemes used by the sensor control circuitry 170 to monitor printhead dies 114 for cracks. Memory 184 may store a number of threshold limits associated with the detection of cracks in printhead die 114 by control logic 178, as described herein.

Figure 5:
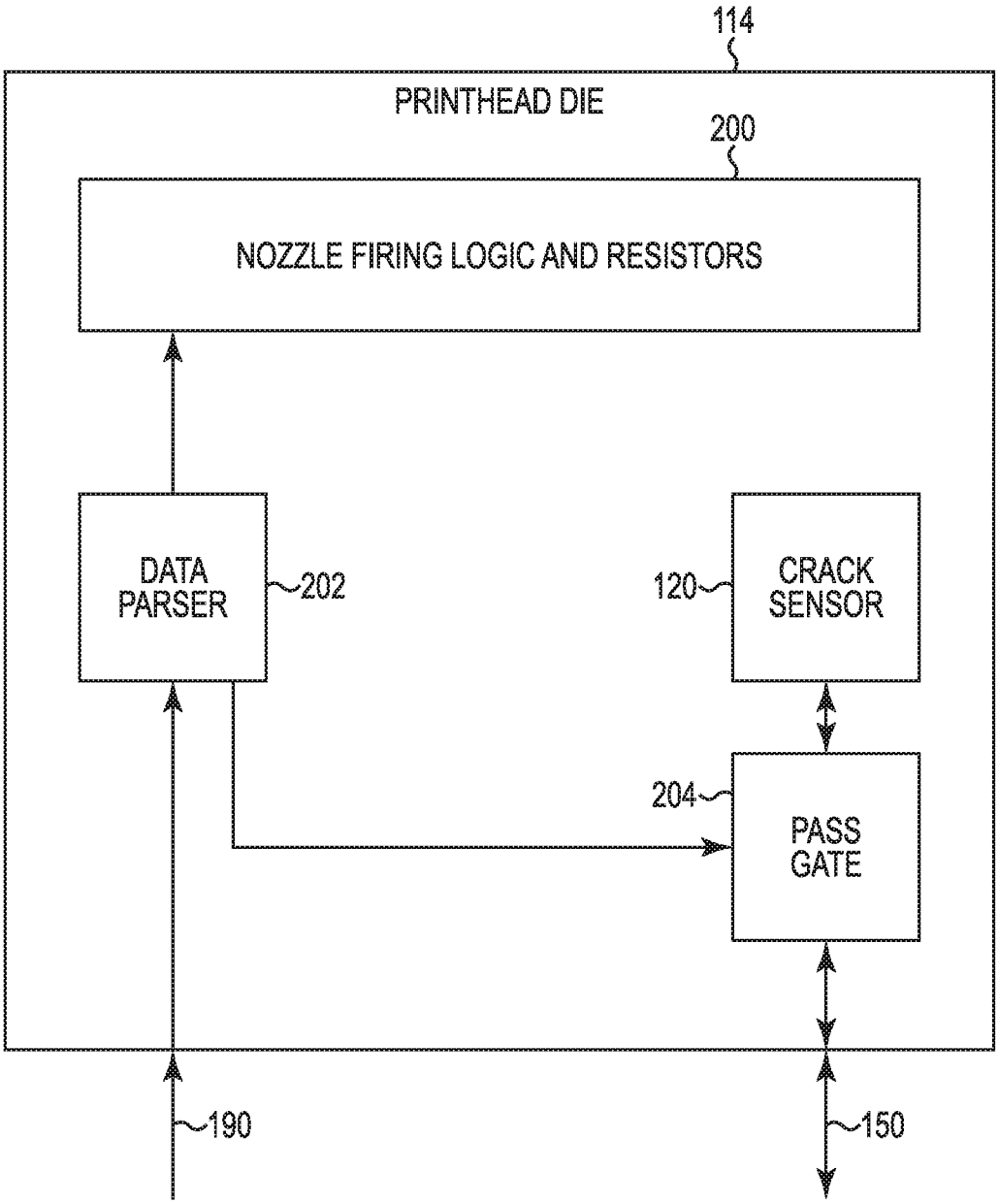
FIG. 5 is a block and schematic diagram of a printhead die according to one example.

FIG. 5 is a block and schematic diagram illustrating a printhead die 114 according to one example, such as printhead dies 114-1, 114-2, and 114-3 to **114-*n* of FIG. 4. Printhead die 114 includes nozzle firing logic and resistors 200, a data parser 202, and a crack sensor 120 with a corresponding pass gate 204. Data parser 202 is connected to a corresponding printhead data line 190 from data parser 172 of ASIC 126, and pass gate 204 is coupled to analog bus 150**.

As described above, according to one example, crack sensor 120 is a resistor. In example, printhead die 114 includes a number of pass gates 204 and a number of crack sensors 120. In one example, crack sense resistor 120, as generally illustrated by FIG. 2, is disposed about a perimeter edge of printhead die 114. In another example, multiple crack sense resistors 120 are disposed at a number of different locations within printhead die 114, such as at corners of ink slots feeding nozzles 116, for example, with each crack sense resistor 120 having a corresponding pass gate 204.

Referring to FIGS. 4 and 5, an illustrative example of the operation of sensor controller ASIC 126 and printhead dies 114 of wide array printhead assembly 102 for the detection of cracks in printhead dies 114 is described below. In accordance with the present disclosure, ASIC 126, via crack sense resistors 120 and pass gates 204, is configured to monitor printhead dies 114 for cracks using any number of different monitoring schemes. In one example, RRSM 180 determines and executes a number of monitoring schemes for performing crack sensing on the individual printhead dies 114. One such monitoring scheme is a round-robin scheme where the printhead dies 114 are successively monitored without priority in a repeating order. Any number of other monitoring schemes are possible, as will be described in greater detail below.

In one example of a round-robin monitoring scheme, ASIC 126 instructs fixed current source 176 to provide a known current on analog bus 150, which, as described above, is connected in parallel to all printhead dies 114. RRSM 180 sends a command to an individual printhead die, such as printhead die 114-1, instructing the printhead die to operate pass gate 204 controlling crack sense resistor 120. In one example, control logic 178 and RRSM 180 provides the command to data parser 172 via command line 196. Data parser 172, in-turn, embeds the command within a print data stream received from electronic controller 110 (see FIG. 1) via print data line 192 and transmits the command along with the print data to the appropriate printhead die 114 via its corresponding printhead data line 190, such as printhead data line 190-1 to printhead die 114-1. In another example, as illustrated and described below by FIG. 6, in lieu of providing commands controlling pass gates 204 in the print data stream via printhead data lines 190, commands are provided via a separate control bus 198 connected to each printhead die 114.

In each printhead die 114, data parser 202 receives the print data stream from ASIC 126 via the corresponding printhead data line 190, parses the print data to generate parse nozzle data, and provides the parsed nozzle data to the nozzle firing logic and resistors which eject ink drops in response thereto. In one example, data parser 202 further acts as control logic by receiving the crack sensing control commands embedded within the print data stream by ASIC 126 and received via printhead data line 190.

With regard to the illustrative example, in response to the control command, data parser 202 of printhead die 114-1 instructs pass gate 204 to connect corresponding crack sense resistor 120 to analog bus 150. According to the illustrative example, all other printhead dies 114 are disconnected from analog bus 150 by their corresponding pass gates 204. Upon connection to analog bus 150, the known current provided by fixed current source 176 flows through the crack sense resistor 120 of printhead die 114-1 and a resulting voltage is produced on analog bus 150.

In one example, ADC 174 receives and converts the resulting voltage on analog bus 150 to a digital value. Control logic 178 receives the digital value of the resulting voltage on analog bus 150 and compares the value to a predetermined maximum limit or threshold. In one example, the predetermined maximum threshold is hard-wired into control logic 178. In one example, the predetermined maximum threshold is set in configuration register 182. In one example, the predetermined maximum threshold is stored in memory 184.

In one example, in lieu of using ADC 174, control logic 178 receives the resulting voltage on analog bus 150 and makes a direct analog comparison of the resulting voltage with the maximum threshold using analog comparators (not illustrated).

The magnitude of the resulting voltage on analog bus 150 is an indication of the resistance of crack sense resistor 120. When crack sense resistor 120 is intact, based on the known resistance of crack sense resistor 120, a resulting voltage is expected to be at or within a range of voltage values which is below the maximum limit. If the resulting voltage is less than the maximum limit, printhead die 114-1 is deemed to be intact (i.e. not cracked). If a crack transects crack sense resistor 120, its resistance will increase and the value of the resulting voltage on analog bus 150 will also increase. If the resulting voltage is above the maximum limit, control logic 178 deems printhead die 114-1 to be cracked, and ASIC 126 communicates the "cracked" status of printhead die 114-1 to electronic controller 110 of printing system 100.

In one example, control logic 178 additionally compares the resulting voltage on analog bus 150 to a minimum threshold value. If the resulting voltage is found to be below the minimum threshold value, control logic 178 determines that there is a defect in the crack detect circuitry on printhead die 114 (e.g. pass gate 204 and crack sense resistor 120), such as a short to another signal (e.g., a short to ground). In such case, ASIC communicates the "defect" status to electronic controller 110.

In one example, minimum and maximum threshold comparison values, for both digital and direct analog comparison by control logic 178 are programmable. In one example, control logic 178, based on the known current level and resulting voltage on analog bus 150, determines and stores resistance values (e.g. in memory 184) associated with crack sense resistors 120. In one example, such stored resistance values are accessible via electronic controller 110.

Once the crack status of printhead die 114-1 has been determined, pass gate 204 of printhead die 114-1 "opens" and disconnects crack sense resistor 120 from analog bus 150. RRSM 180 then moves to the next printhead die 114 which is to be evaluated, such as printhead die 114-2. The above described process is repeated for printhead die 114-2, with the control commands being directed by ASIC 126 via the corresponding printhead data line 190-2. The process is repeated until all printhead dies 114 have been crack-checked I accordance with the round robin monitoring scheme being employed, such as the round-robin scheme of the illustrative example. The round-robin scheme is then repeated.

Any number of monitoring schemes other than the illustrative round-robin scheme described above may be employed to carry out crack monitoring of printhead dies 114. Another example of round-robin scheme involves checking crack sense resistors of every other printhead die 114 are monitored, followed by monitoring of the alternating printhead die 114 that were skipped.

In another example, each printhead die 114 may include multiple crack sense resistors 120, such as crack sense resistors 120 disposed about a perimeter edge of printhead die 114 and crack sense resistors 120 disposed along the edges of ink slots, such as at etched or machined corners thereof, for example. According to one monitoring scheme, crack sense resistors 120 of a first type, such as those disposed about perimeter edges of printhead dies, are monitored for each printhead 114 in order, with the scheme then looping back to check crack sense resistors 120 disposed at ink slot corners for each printhead in order.

In another example of a monitoring scheme, an adaptive monitoring scheme is employed where printhead dies 114 which disposed at locations experiencing greater thermal or other fluctuations are monitored more frequently that printhead dies 114 not experiencing such fluctuations.

In another example, some crack sense resistors 120 within the printhead dies 114 may be monitored more frequently than other crack sense resistors. For example, crack sense resistors 120 disposed at areas within the printhead die 114 that experience greater thermal fluctuations may be monitored more frequently than crack sense resistors 120 disposed at other locations within printhead die 114. Similarly, crack sense resistors 120 within printhead die disposed at corners of ink slots may be monitored more frequently than crack sense resistors disposed about the perimeter of printhead die 114.

In another monitoring scheme, multiple printhead dies 114 may be monitored in parallel. For example, crack sense resistors 120 of printhead dies 114-1 and 114-2 may be monitored in parallel. According to such an example, RRSM 180 embeds commands in the print data streams for both printhead dies 114-1 and 114-2, instructing the data parser 202 of each printhead to instruct pass gate(s) 204 to connect the corresponding crack sense resistor(s) 120 to analog bus 150. The parallel combination of the known resistance values of the parallel-connected crack sense resistors of printhead dies 114-1 and 114-2 is expected to produce a voltage on analog bus 150 of an expected magnitude.

As described above, control logic 178 compares the resulting voltage on analog bus 150 to a maximum value. If the value of the resulting voltage is less than the maximum value, the crack sense resistors of both printhead die 114-1 and 114-2 are deemed "not cracked". If the value of the resulting voltage on analog bus 150 is greater than the maximum value, control logic 178 determines that at least one of the printhead dies 114-1 and 114-2 is cracked, and then checks printhead dies 114-1 and 114-2 independently to determine whether one, or both, are cracked.

Any number of different monitoring schemes, or combinations of the above monitoring schemes may be employed for crack monitoring of printhead dies 114 by ASIC 126.

Figure 6:
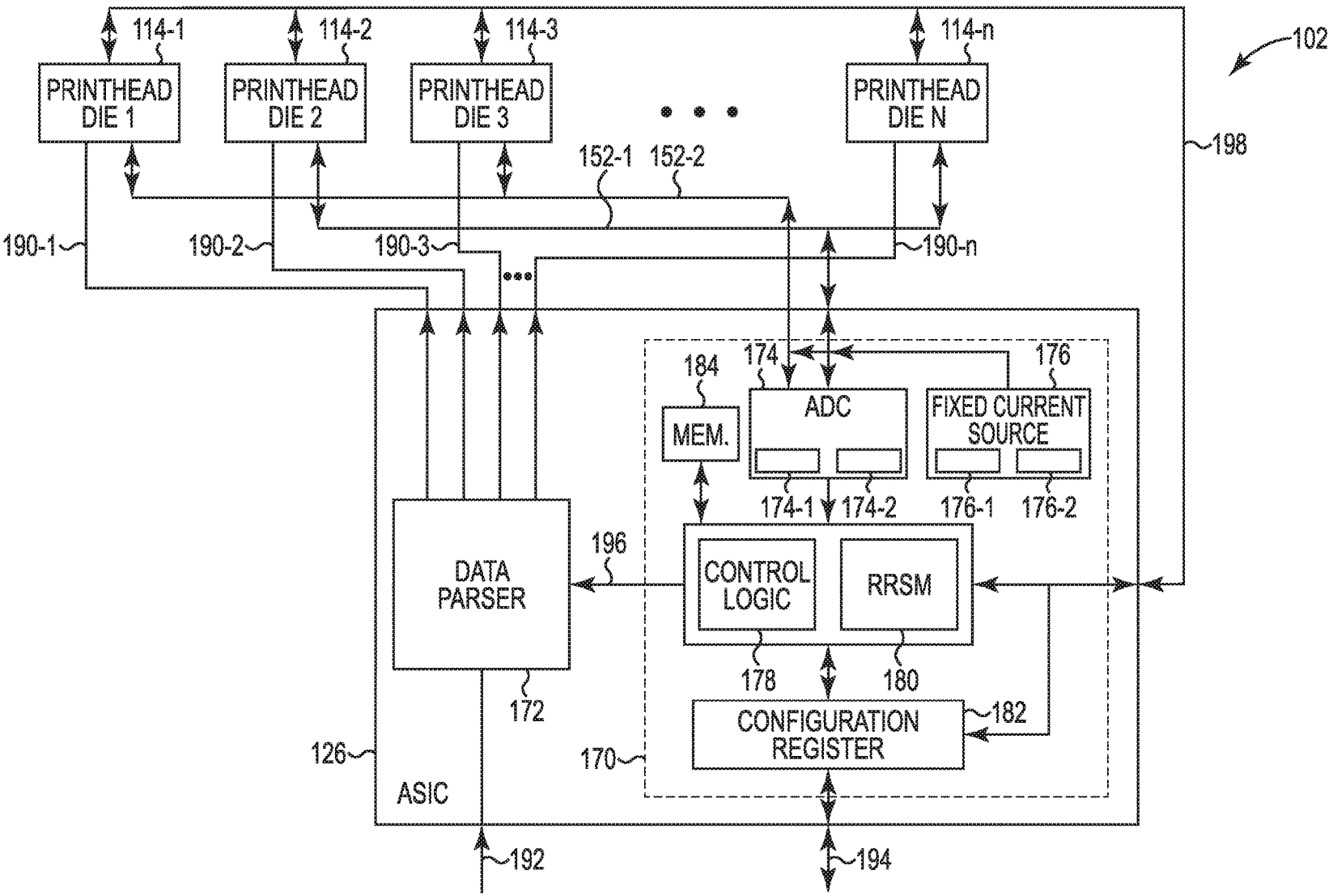
FIG. 6 is a block and schematic diagram of a printhead having crack sensing for multiple printhead die according to one example.

FIG. 6 is a block and schematic diagram of another example of printhead assembly 102 including a crack sensing circuitry, including ASIC 126, in accordance with the present disclosure. In contrast to the example of FIG. 4, ASIC 126 includes multiple ADCs 174 (e.g. 174-1 and 174-2) and multiple fixed current sources 176 (e.g. 176-1 and 176-2) which are connected to different groups of printhead dies 114 by multiple analog buses 150. In the illustrated example, a pair of analog buses 152-1 and 152-2 are employed, with analog bus 152-1 being connected to printhead dies 114-2 and **114-*n*, and analog bus 152-2 being connected to printhead dies 114-1 and 114-3**.

In operation, a first current source 176-1 can provide a first current on first analog bus 152-1 to one or more of the crack sense resistors 120 of printhead dies 114-2 and **114-*n*, with the resulting voltage on analog bus 152-1 being converted to a digital value by a first ADC 174-1 and monitored by control logic 178. Simultaneously, a second current source 176-2 can provide a first current on second analog bus 152-2 to one or more of the crack sense resistors 120 of printhead dies 114-1 and 114-3, with the resulting voltage on analog bus 152-2 being converted to a digital value by a second ADC 174-2 and monitored by control logic 178. In this way, a first current source 176-1 and first analog bus 150-1 may be settling in preparation for conversion of the resulting voltage thereon by a first ADC 174-1, while the other analog bus 150-2 is stable and having a resulting voltage thereon converted to a digital value by a second ADC 174-2. This allows multiple processes to be performed during the same period of time that may be otherwise prohibitive when using a single analog bus 150**.

According to the example of FIG. 6, printhead assembly 102 further includes a control bus 198 connected between ASIC 126 and each of the printhead dies 114. In the example of FIG. 6, control commands may be sent from control logic 178, RRSM 180, and configuration register 182 directly to printhead dies 114 via control bus 198 in lieu of embedding such commands in the print data stream, as illustrated by the example of FIG. 4. According to one example, similar to that described above by FIGS. 4 and 5, commands from control bus 198 are transmitted to data parsers 202 of printhead dies 114 which instruct pass gates 204 to connect corresponding crack sense resistors 120 to the corresponding analog bus 150 in order to obtain voltage signals for crack sensing as described above.

Figure 7:
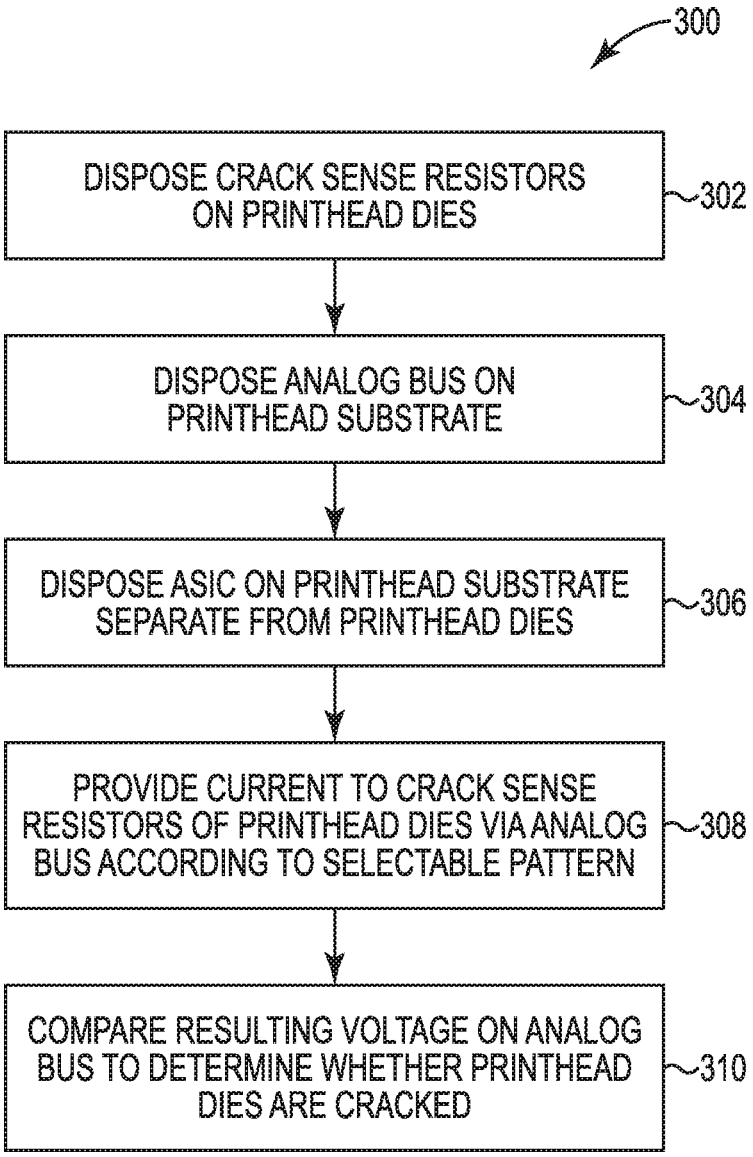
FIG. 7 is a flow diagram a flow diagram illustrating a method of detecting cracks in a plurality of printhead dies of a printhead, according to one example.

FIG. 7 is a flow diagram illustrating generally an example of a method 300 of detecting cracks in a plurality of printhead dies disposed on a substrate of an inkjet printhead, such as printhead die 114 disposed of wide array inkjet printhead 102 of FIG. 4. At 302, the method includes disposing at least one crack sense resistor on each printhead dies of the plurality of printhead dies, such as crack sense resistors 120-1, 120-2, and 120-3 to **120-*n* or printhead dies 114-1, 114-2, and 114-3 to 114-*n* of wide array inkjet printhead 102 of FIG. 3**.

At 304, the method includes disposing at least one analog bus on the substrate which is electrically coupled to the at least one crack sense resistor of each printhead die, such as analog bus 150 of FIG. 4, which is electrically coupled to each crack sense resistor 120 of each printhead die 114 via a corresponding pass gate 204 of each printhead die 114, as illustrated by FIG. 5.

At 306, the method includes disposing an application specific integrated circuit (ASIC) on the printhead substrate, where the ASIC is separate from each printhead die of the plurality of printhead dies, such as ASIC 126 being disposed on substrate 160 of wide array inkjet printhead 102 illustrated by FIG. 3.

At 308, method 300 includes, providing with the ASIC, a known current via the at least one analog bus to the at least one crack sense resistor of each printhead die according to a selectable pattern, such as ASIC 126 providing a known current provided by fixed current source 176 to each of the crack sense resistors 120 of printhead dies 114 of FIG. 4. In one example, as described above, the selectable pattern is a repeating round-robin pattern where the known current is successively provided to the at least one crack sensor of each printhead in a repeating order (e.g. to crack sense resistor 120 of printhead die 114-1, then to crack sense resistor 120 of printhead die 114-2, and so on).

In another example, the selectable pattern includes providing the known current to the at least one crack sense resistor of multiple printhead dies connected in parallel to the at least one analog bus. For example, with reference to FIGS. 4 and 5, crack sense resistors 120 of printhead dies 114-1 and 114-2 are connected in parallel to analog bus 150 via their corresponding pass gates 204. The known current from fixed current source 176 is provided on analog bus 150 is provided to the parallel-connected crack sense resistors 120 of printhead dies 114-1 and 114-2, with a resulting voltage being produced on analog bus 150.

At 310, the ASIC compares a resulting voltage produced on the analog bus in response to the known current being provided to the at least one crack sense resistor of each printhead die to a predetermined threshold to determine whether the printhead die is cracked. For example, with reference to FIG. 4, as described above, ADC 174 converts the resulting voltage on analog bus 150 to a digital value, with the digital value being compared by control logic 178 to threshold values stored in configuration register 182, for example. Based on a known resistance of the at least one crack sense resistor 120, the resulting voltage on analog bus 150 will be close to an expected value if the crack sense resistor 120 is intact (i.e., not cracked). If the resulting voltage exceeds a threshold value, which is higher than the expected voltage, the crack sense resistor has likely been bisected by a crack, meaning that printhead die 114 is cracked. Indication of the printhead die being cracked is provided by ASIC 126 to printing system 102 (see FIG. 1).

By locating crack sensor control circuitry 170, including one or more ADCs 174, one or more fixed current sources 176, control logic 178, RRSM 180, and configuration register 182, for example, on ASIC 126, redundant sets of such elements/components are eliminated from being separately disposed on each printhead die 114. Such arrangement saves space on printhead dies 114 and reduces manufacturing costs. Additionally, because it is not located on a printhead die, ASIC 126 is not limited by special fabrication requirements associated with expensive printhead die silicon, so that fabrication of ASIC 126 can employ optimized silicon processes that are well-suited for high performance, high precision ADC circuits as well as that of control logic 178, RRSM 180, and configuration register 182, for example. Furthermore, locating crack sensing functions on ASIC 126 provides more flexibility and configurability of crack sensing schemes which can be employed by ASIC 126 as opposed to having redundant crack sensing control circuitry disposed on each printhead die 114.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printhead comprising:

a plurality of printhead dies, each printhead die including at least one crack sense resistor;

at least one analog bus connected to each printhead die, the at least one analog bus to communicate analog voltage signals to facilitate a printer controller to determine whether at least one of the printhead dies is cracked, the analog voltage signals communicated by the at least one analog bus confined to the printhead.

2. The printhead of claim 1, each printhead die including multiple crack sense resistors disposed at different locations on the printhead die.

3. The printhead of claim 1, the at least one crack sense resistor comprising a wire.

4. The printhead of claim 1, the at least one crack sense resistor disposed about a perimeter of the printhead die.

5. The printhead of claim 1, the at least one crack sense resistor including at least one of a crack sense resistor disposed at each corner of at least one ink slot on the printhead and a crack sense resistor disposed about a perimeter of the at least one ink slot.

6. The printhead die of claim 1, the printhead dies connected in parallel to the analog bus.

7. A printhead comprising:

an analog bus confined to the printhead; and a plurality of printhead dies, each printhead die including:

a plurality of crack sense elements; and a plurality of pass gates, each pass gate corresponding to a different one of the crack sense elements, each pass gate to selectively couple the corresponding crack sense element to the analog bus, the analog bus to provide a sense current to each crack sense element selectively coupled thereto with a resulting analog voltage signal on the analog bus representative of whether any crack sense element selectively coupled to the analog bus indicates the presence of a crack on the corresponding printhead die, the analog voltage signal confined to the printhead.

8. The printhead of claim 7, each crack sense element and corresponding pass gate together representing a crack sense circuit, the resulting voltage on the analog bus representative of whether any crack sense circuits selectively coupled the analog bus are defective.

9. The printhead of claim 7, each crack sense element comprising a wire.

10. The printhead of claim 7, the plurality of crack sense elements including a crack sense element disposed about a perimeter edge of the printhead die.

11. The printhead of claim 7, the plurality of crack sense elements including at least one of a crack sense element disposed at each corner of at least one ink slot on the printhead.

12. The printhead of claim 7, each printhead die of the plurality of printhead dies to print with a different color ink.

13. The printhead of claim 7, including a control bus connected to printhead die of the plurality of printhead dies, the control bus to carry commands to selectively couple crack sense elements to the analog bus via the pass gates.

14. The printhead of claim 7, where crack sense elements selectively coupled to the analog bus are connected in parallel with one another.

15. A printhead comprising:

a plurality of analog buses, each analog bus confined to the printhead;

a plurality of printhead dies arranged into groups of printhead dies, each group of printhead dies corresponding to a different analog bus of the plurality of analog buses, each printhead die including:

at least one crack sense element, the at least one crack sense element of each printhead die of each group of printhead dies to selectively couple to the corresponding analog bus; and an analog voltage signal on each analog bus indicative of whether at least one printhead die of the corresponding group of printhead dies is cracked at a given time when at least one crack sense element is selectively coupled to the analog bus, the analog voltage signal confined to the printhead.

16. The printhead of claim 15, for each analog bus, the crack sense elements arranged such that all crack sense elements selectively coupled thereto at a given time are connected in parallel.

17. The printhead of claim 15, each crack sense element comprising a wire.

18. The printhead of claim 15, each crack sense element having a corresponding pass gate to selectively coupled the crack sense element to the corresponding analog bus.

19. The printhead of claim 18, comprising:

a plurality of data lines, each data line connected to a different one of the printhead dies of the plurality of printhead dies, each data line to carry print data to nozzles and commands to selectively couple crack sense elements via the pass gates to the analog bus corresponding to the respective printhead die.

20. The printhead of claim 15, comprising:

a control bus coupled to each printhead die of the plurality of printhead dies, the control bus to carry control commands to the printhead dies to selectively couple crack sense elements to the analog bus via the pass gates.

21. A printhead comprising:

an analog bus confined to the printhead; and a printhead die connected to the analog bus, the printhead die including:

one or more crack sense elements, each of the one or more crack sense elements to selectively couple to the analog bus; and an analog voltage signal on the analog bus representative of whether any of the one or more crack sense elements selectively coupled to the analog bus at a given time indicate a presence of a crack on the printhead die, the analog voltage signal confined to the printhead.

22. The printhead of claim 21, each of the one or more crack sense elements having a corresponding pass gate to selectively couple the crack sense element to the analog bus.

23. The printhead of claim 22, including:

a control bus connected to the printhead die, the control bus to carry commands to selectively couple each of the one or more crack sense elements to the analog bus via the corresponding pass gate.

24. The printhead of claim 21, the analog bus to provide a fixed current to the one or more crack sense elements selectively coupled thereto to produce the voltage on the analog bus.

25. The printhead of claim 21, the one or more crack sense elements including at least one crack sense element disposed about a perimeter of the printhead die.

26. The printhead of claim 21, the printhead die including at least one ink slot, and the one or more crack sense elements including at least one crack sense element disposed along a perimeter edges of the at least one ink slot.

27. The printhead of claim 26, the one or more crack sense elements including a crack sense element at each corner of the at least one ink slot.

* * * * *